US007583919B2

(12) United States Patent
Suzuki et al.

(10) Patent No.: US 7,583,919 B2
(45) Date of Patent: Sep. 1, 2009

(54) COLOR IMAGE FORMING APPARATUS CAPABLE OF EFFECTIVELY MATCHING REGISTRATION BETWEEN ELEMENTARY COLOR IMAGES

(75) Inventors: Shingo Suzuki, Kanagawa-ken (JP); Nobuyuki Yanagawa, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 11/357,032

(22) Filed: Feb. 21, 2006

(65) Prior Publication Data

US 2006/0192838 A1 Aug. 31, 2006

(30) Foreign Application Priority Data

Feb. 24, 2005 (JP) ..... 2005-048183

(51) Int. Cl.
*G03G 15/01* (2006.01)

(52) U.S. Cl. ..... 399/301; 399/49; 399/298; 399/299; 347/116

(58) Field of Classification Search ..... 399/301, 399/298, 299, 49; 347/116
See application file for complete search history.

(56) References Cited

U.S. PATENT DOCUMENTS

| | | | |
|---|---|---|---|
| 4,348,106 | A | 9/1982 | Suzuki et al. |
| 4,359,670 | A | 11/1982 | Hosaka et al. |
| 4,364,656 | A | 12/1982 | Yanagawa |
| 4,365,888 | A | 12/1982 | Hosaka et al. |
| 4,378,416 | A | 3/1983 | Yanagawa et al. |
| 4,402,103 | A | 9/1983 | Yanagawa et al. |
| 4,406,535 | A | 9/1983 | Sakamoto et al. |
| 4,451,139 | A | 5/1984 | Yanagawa et al. |
| 4,474,453 | A | 10/1984 | Yanagawa et al. |
| 4,487,501 | A | 12/1984 | Suzuki et al. |
| 4,615,607 | A | 10/1986 | Yanagawa et al. |

(Continued)

FOREIGN PATENT DOCUMENTS

| | | |
|---|---|---|
| JP | 7-325455 | 12/1995 |

(Continued)

OTHER PUBLICATIONS

Takeyama (English Translation) JP 2002072605.*

(Continued)

*Primary Examiner*—David M Gray
*Assistant Examiner*—Ryan D Walsh
(74) *Attorney, Agent, or Firm*—Oblon, Spivak, McClelland, Maier & Neustadt, P.C.

(57) ABSTRACT

Image forming apparatus includes image forming units, an intermediate transfer member, a mark detecting mechanism, a counter, and a controller. The intermediate transfer member have marks. A distance between nth and (n+1)th marks is substantially equal to or smaller than a difference between a distance from a write position of the nth image forming unit to a primary transfer position of the (n+1)th image forming unit and a distance from a write position of the (n+1)th image forming unit to the primary transfer position of the (n+1)th image forming unit. The controller controls the nth image forming unit to start writing when the mark detecting mechanism detects the nth mark and the counter reaches a predetermined count value, and controls the (n+1)th image forming unit to start writing when the mark detecting mechanism detects the (n+1)th mark and the counter reaches another predetermined count value.

16 Claims, 13 Drawing Sheets

U.S. PATENT DOCUMENTS

| | | | | |
|---|---|---|---|---|
| 4,717,939 | A | 1/1988 | Yanagawa | |
| 4,921,236 | A | 5/1990 | Saeki et al. | |
| 6,157,797 | A | 12/2000 | Saito et al. | |
| 6,215,974 | B1 | 4/2001 | Katoh et al. | |
| 6,222,566 | B1 | 4/2001 | Takeyama et al. | |
| 6,256,461 | B1 | 7/2001 | Takeyama et al. | |
| 6,263,178 | B1 | 7/2001 | Takeyama et al. | |
| 6,292,641 | B1 | 9/2001 | Takeyama et al. | |
| 6,332,066 | B1 | 12/2001 | Yanagawa | |
| 6,336,024 | B1 | 1/2002 | Kanaya et al. | |
| 6,574,442 | B2 * | 6/2003 | Kibune | 399/49 |
| 6,674,982 | B2 | 1/2004 | Saitoh et al. | |
| 6,718,151 | B2 | 4/2004 | Kibune et al. | |
| 6,832,061 | B2 | 12/2004 | Saito et al. | |
| 6,839,531 | B2 | 1/2005 | Saitoh et al. | |
| 6,842,598 | B2 | 1/2005 | Kibune et al. | |
| 6,891,554 | B2 | 5/2005 | Takeyama et al. | |
| 6,919,911 | B2 | 7/2005 | Takeyama et al. | |
| 6,920,291 | B2 | 7/2005 | Saitoh et al. | |
| 2001/0031148 | A1 | 10/2001 | Kajiwara et al. | |
| 2003/0142996 | A1 * | 7/2003 | Hiroki | 399/227 |
| 2004/0239745 | A1 | 12/2004 | Takeyama et al. | |
| 2004/0258433 | A1 | 12/2004 | Saito et al. | |
| 2005/0002686 | A1 | 1/2005 | Saitoh et al. | |
| 2005/0226643 | A1 | 10/2005 | Saitoh et al. | |
| 2005/0285922 | A1 | 12/2005 | Suzuki et al. | |

FOREIGN PATENT DOCUMENTS

| | | | | |
|---|---|---|---|---|
| JP | 2002-72605 | | | 3/2002 |
| JP | 2002108047 | A | * | 4/2002 |
| JP | 2006011154 | A | * | 1/2006 |

OTHER PUBLICATIONS

Patent Abstracts of Japan, JP 02-167573, Jun. 27, 1990.
Patent Abstracts of Japan, JP 2000-250281, Sep. 14, 2000.

* cited by examiner

COLOR IMAGE FORMING APPARATUS CAPABLE OF EFFECTIVELY MATCHING REGISTRATION BETWEEN ELEMENTARY COLOR IMAGES

BACKGROUND OF THE INVENTION

1. Field of the Invention

The present invention relates to a color image forming apparatus, and more particularly to a color image forming apparatus capable of effectively matching registration between elementary color images.

2. Discussion of the Background

A background full-color image forming apparatus according to an electrophotographic method generally forms toner images of a plurality of elementary colors, such as yellow, magenta, cyan, and black, and sequentially superimposes them on an intermediate transfer member, thereby forming a full-color image on the intermediate transfer member. Then, the full-color image is transferred from the intermediate transfer member onto a recording medium. The apparatus thus performs a full-color image forming. In this operation, however, if the images of the respective elementary colors are not precisely superimposed with respect to the intermediate transfer member, the full-color image formed by the toner images of the elementary colors on the intermediate transfer member has a so-called color drift and is transferred with the color drift onto the recording medium. As a result, quality of an obtained image is deteriorated because of the color drift. Therefore, in order to form a high-quality image, a position control is necessary for aligning start positions of transferring images of the elementary colors on the intermediate transfer member.

There is one attempt to solve this problem. In this case, a full-color image forming apparatus has a structure in which a single photoconductor is employed, and an intermediate transfer belt and a plurality of development devices of different colors are placed to face this photoconductor. With this structure, each time a toner image of a color is formed on the photoconductor, the toner image is transferred to the intermediate transfer belt. Thus, a plurality of toner images are transferred to and superimposed into a full-color image on the intermediate transfer belt, and such a full-color image is transferred to a recoding medium.

This full-color image forming apparatus includes a first reference signal generating mechanism for generating a first reference signal indicating a reference position of the photoconductor, a mark forming mechanism for forming a reference mark according to the first reference signal, and a second reference signal generating mechanism for detecting the reference mark and generating a second reference signal for the intermediate transfer belt. To prevent the above-mentioned color drift in superimposing the color toner images, the full-color image forming apparatus starts transferring an image of a first color on the photoconductor according to the first reference signal, and further transfers images of the second and subsequent colors on the photoconductor based on the second reference signal. This attempt, however, cannot be applied to a full-color image forming apparatus having a structure in which a plurality of photoconductors are employed.

There is another attempt to solve the problem. In this attempt, a full-color image forming apparatus includes a plurality of image forming-mechanisms and an intermediate transfer member placed to face the plurality of image forming mechanisms. Each of the plurality of image forming mechanisms includes an image carrying member, a writing mechanism, at least two development mechanisms for developing an electrostatic latent image formed on the image carrying member by the writing mechanism, and a switching mechanism for alternatively selecting to drive one of the at least two development mechanisms.

The intermediate transfer member includes a non-image region in which a plurality of marks are formed at equal intervals in a rotation direction of the intermediate transfer member. The full-color image forming apparatus further includes a detection mechanism for detecting the plurality of marks, and a PLL (phase-locked loop) circuit to which a signal output from the detection mechanism is input. The PLL circuit outputs a reference signal for starting an image writing performed by the writing mechanism. With this configuration, the full-color image forming apparatus can prevent a jitter of the toner image in a sub-scanning direction and a color drift in the toner images superimposed on the intermediate transfer member. This attempt, however, is required to align the plurality of marks with extremely high accuracy. Further, this structure cannot cope with deterioration over time of the intermediate transfer member and changes of an environment in which the full-color image forming apparatus is used.

SUMMARY OF THE INVENTION

Under the above-described circumstances, the present invention aims to provide a color image forming apparatus which forms a full-color image by highly accurately superimposing images of a plurality of colors on an intermediate transfer member by using a plurality of image forming units placed along a moving surface of the intermediate transfer member, and which is capable of flexibly coping with a change over time and a change in speed of the intermediate transfer member having a simplified structure.

Accordingly, this patent specification describes a novel color image forming apparatus which includes a plurality of image forming units, an intermediate transfer member, a mark detecting mechanism, a counter, a count value memory unit, and a controller. The plurality of image forming units includes nth and (n+1)th image forming units numbered in an order of a predetermined image forming sequence and is configured to write latent images on rotating image carrying members at write positions and to develop the latent images. The intermediate transfer member is configured to rotate to pass respective transfer positions at which the developed images are transferred to the intermediate transfer member from the respective image carrying members of the plurality of image forming units. The intermediate transfer member is further configured to have a plurality of marks including nth and (n+1)th marks and placed along a rotation direction of the intermediate transfer member. An interval between the nth and (n+1)th marks is substantially equal to or smaller than a distance difference between a distance from a write position of the nth image forming unit to a primary transfer position of the (n+1)th image forming unit and a distance from a write position of the (n+1)th image forming unit to the primary transfer position of the (n+1)th image forming unit. The mark detecting mechanism is configured to detect the marks at a fixed position. The counter is configured to be reset to start counting upon a detection of each of the marks by the mark detecting mechanism. The count value memory unit is configured to store a count value $C_n$ counted during a time period from a detection of the nth mark until a start of writing on the image carrying member in the nth image forming unit, and also a count value $C_{(n+1)}$ counted during a time period from detection of the (n+1)th mark until a start of writing on the image carrying member in the (n+1)th image forming unit. The controller is configured to control the nth image forming unit to start writing on the image carrying member thereof when the mark detecting mechanism detects the nth mark and the counter reaches the count value $C_n$, and to control the (n+1)th image forming unit to start writing on the image carrying member thereof when the mark detecting mechanism detects the (n+1)th mark and the counter reaches the count value $C_{(n+1)}$.

According to the above image forming apparatus of the present invention, optical writing of each color starts at predetermined counts after detection of a mark. Therefore, an interval between marks is not required to be highly accurately equalized with an interval between transfer positions of a plurality of image carrying members. Accordingly, the image forming apparatuses of the present invention can accurately superimpose toner images and flexibly cope with a change in speed and a change over time of an intermediate transfer member, while simplifying the structure of the intermediate transfer member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
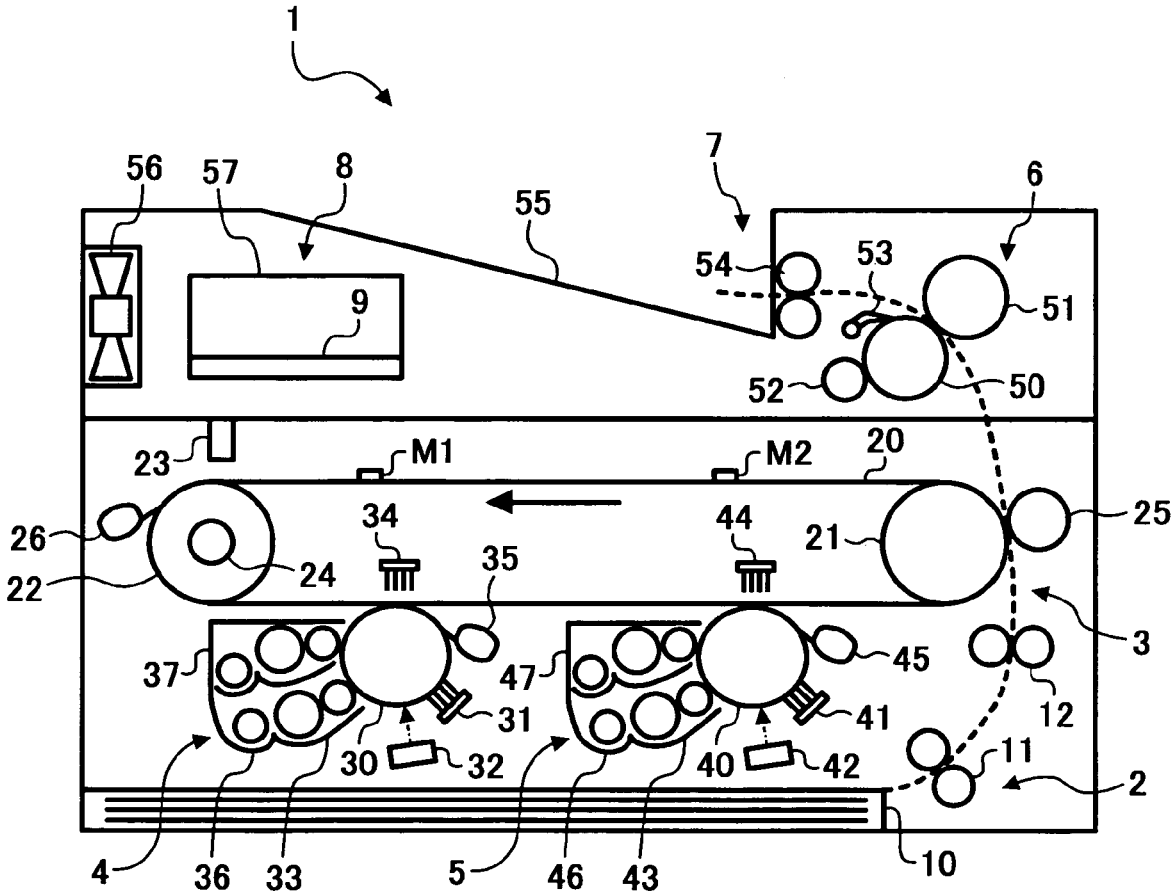
FIG. 1 is a schematic illustration of a color image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a color image forming apparatus 1 according to an embodiment of the present invention is explained.

As illustrated in FIG. 1, the color image forming apparatus 1 includes a sheet-feeding unit 2, a secondary transfer unit 3, a first image forming unit 4, a second image forming unit 5, a fixing unit 6, a sheet-discharging unit 7, an electric device 8, and a control unit 9.

The sheet-feeding unit 2 includes a sheet-feeding tray 10, a pair of feed rollers 11, and a pair of registration rollers 12. The sheet-feeding tray 10 stores a stack of transfer sheets. The pair of feed rollers 11 send out the transfer sheets one by one from the sheet-feeding tray 10 along a sheet passage indicated by dotted lines. The pair of registration rollers 12 convey the transfer sheets sent out of the sheet-feeding tray 10 to the secondary transfer unit 3 at an adjusted timing.

The secondary transfer unit 3 includes an intermediate transfer belt 20, a first drive roller 21, a second drive roller 22, a mark detecting unit 23, a speed detecting unit 24, a secondary transfer roller 25, and a belt cleaning unit 26.

The intermediate transfer belt 20 is an endless belt supported by the first drive roller 21 and the second drive roller 22, and is sequentially surrounded by the first image forming unit 4, the second image forming unit 5, the secondary transfer roller 25, and the belt cleaning unit 26. The first drive roller 21 and the second drive roller 22 drive the intermediate transfer belt 20 to rotate in a direction indicated by an arrow. The intermediate transfer belt 20 includes an outer circumferential surface edge, perpendicular to a belt rotation direction and outside an area of toner image forming, on which marks M1 and M2 are formed at an interval in the belt rotation direction. The marks M1 and M2 are line-shaped and are configured to reflect light more strongly than the other area of the intermediate transfer belt 20.

The mark detecting unit 23 is fixed to a stationary member located above a traveling route of the marks M1 and M2. The mark detecting unit 23 uses a light-emitting element such as an LED (light-emitting diode) for emitting light to the intermediate transfer belt 20, and a light-receiving element such as a photosensor for receiving light reflected from the intermediate transfer belt 20. Thereby, the mark detecting unit 23 detects a passage of the marks M1 and M2 based on a change in intensity of the reflected light. The speed detecting unit 24 measures a moving speed of the intermediate transfer belt 20.

The secondary transfer roller 25 is placed to face the intermediate transfer belt 20 at a downstream position of the second image forming unit 5 in the belt rotation direction. The secondary transfer roller 25 performs a secondary transfer operation. In the secondary transfer operation, a plurality of elementary color toner images, i.e., a full-color toner image, formed on the intermediate transfer belt 20 by the first image forming unit 4 and the second image forming unit 5 are transferred at one time onto the transfer sheet conveyed by the pair of registration rollers 12. After the secondary transfer operation, the belt cleaning unit 26 contacts the intermediate transfer belt 20 and removes therefrom residual toner.

The first image forming unit 4 includes a photoconductor drum 30, a charging unit 31, a writing unit 32, a development unit 33, a primary transfer unit 34, and a drum cleaning unit 35. The photoconductor drum 30 is arranged at a center and is surrounded by the other components mentioned above.

The photoconductor drum 30 serves as an image carrying member and is rotated with a surface moving speed being equal to a surface moving speed of the intermediate transfer belt 20 on which a toner image is formed. The charging unit 31 uniformly charges the photoconductor drum 30 in the dark. The writing unit 32 uses an optical system including an LED (light-emitting diode) combined with a convergent optical transmission member. The optical system writes an electrostatic latent image on the charged photoconductor drum 30 according to a write signal, as the photoconductor drum 30 rotates.

The development unit 33 includes an A-color development device 36 and a C-color development device 37. Switching is performed between development of the A color by the A-color development device 36 and development of the C color by the C-color development device 37 to develop the electrostatic latent images formed on the photoconductor drum 30 into visible toner images of the A color and the C color. In this example, the A color and the C color are cyan and magenta, respectively.

The primary transfer unit 34 performs a primary transfer operation of transferring the toner image of the A color or the C color formed on the photoconductor drum 30 to the intermediate transfer belt 20. The photoconductor drum 30 is usually placed at a slight distance from the intermediate transfer belt 20. In the primary transfer operation from the photoconductor drum 30 to the intermediate transfer belt 20, the primary transfer unit 34 causes the intermediate transfer belt 20 to contact the photoconductor drum 30. After the primary transfer operation, the drum cleaning unit 35 removes residual toner and developer agent from the photoconductor drum 30.

The second image forming unit 5 includes a photoconductor drum 40, a charging unit 41, a writing unit 42, a development unit 43, a primary transfer unit 44, and a drum cleaning unit 45. The photoconductor drum 40 is arrange at a center and is surrounded by other components mentioned above.

The photoconductor drum 40 serves as an image carrying member and is rotated with a surface moving speed being equal to a surface moving speed of the intermediate transfer belt 20 on which a toner image is formed. The charging unit 41 uniformly charges the photoconductor drum 40 in the dark. The writing unit 42 uses an optical system including an LED (light-emitting diode) combined with a convergent optical transmission member. The optical system writes an electrostatic latent image on the charged photoconductor drum 40 according to a write signal, as the photoconductor 40 drum rotates.

The development unit 43 includes a B-color development device 46 and a D-color development device 47. Switching is performed between development of the B color by the B-color development device 46 and development of the D color by the D-color development device 47 to develop the electrostatic latent images formed on the photoconductor drum 40 into visible toner images of the B color and the D color. In this example, the B color and the D color are yellow and black, respectively.

The transfer unit 44 performs a primary transfer operation of transferring the toner image of the B color or the D color formed on the photoconductor drum 40 to the intermediate transfer belt 20. The photoconductor drum 40 is usually placed at a slight distance from the intermediate transfer belt 20. In the primary transfer operation, the transfer unit 44 causes the intermediate transfer belt 20 to contact the photoconductor drum 40. After the primary transfer operation, the drum cleaning unit 45 removes residual toner and developer agent from the photoconductor drum 40.

The fixing unit 6 includes a heating roller 50, a pressure roller 51, a coating roller 52, and a separation claw 53. The heating roller 50 rotates while being heated. The pressure roller 51 rotates together with the heating roller 50, while the pressure roller 51 holds the transfer sheet carrying thereon the toner image at a nip formed between the heating roller 50 and the pressure roller 51 and applies pressure to the transfer sheet. Thereby, the pressure roller 51 conveys the transfer sheet onto which the toner image has been transferred by the secondary transfer unit 3, and fixes the toner image on the transfer sheet. The coating roller 52 contacts the heating roller 50 to coat a surface of the heating roller 50 with an offset preventing liquid, when necessary. The separation claw 53 contacts the heating roller 50 at a downstream position of the nip in a sheet transfer direction to separate the transfer sheet which has passed the nip from the heating roller 50.

The sheet-discharging unit 7 includes a pair of discharging rollers 54 and an output tray 55. The transfer sheet conveyed from the fixing unit 6 is sent onto the output tray 55 by the pair of discharging rollers 54. The electric device 8 includes an exhaust fan 56 and an electric component 57. The exhaust fan 56 exhausts air from the interior of the color image forming apparatus 1. Thereby, an area near the electric component 57 located under the output tray 55 is prevented from being heated by heat of the fixing unit 6.

The control unit 9 is mounted on a circuit substrate forming a part of the electric component 57 of the electric device 8, and controls the entirety of image forming operations of the color image forming apparatus 1.

The color image forming apparatus 1 include, as described above, two image forming unit, i.e., the first and second image forming units 4 and 5. The color image forming apparatus according to the present invention, however, is not necessarily limited to such a structure but it may include more than two image forming units. When a plurality of image forming units are provided, they are preferably placed at regular intervals along the same moving surface of the intermediate transfer belt 20. Also, the toner colors are not necessarily limited to the four colors, i.e., cyan, yellow, magenta, and black.

Furthermore, the color image forming apparatus 1 may use not only the drum-shaped photoconductors, as the image carrying members, but also endless belt-shaped photoconductors. Also, the image carrying members are not necessarily limited to the photoconductors but may be other media on which latent images can be formed without using light. In the color image forming apparatus 1 illustrated above, each of the writing units 32 and 42 includes an LED (light-emitting diode) combined with a convergent optical transmission member. Alternatively, the writing unit may include a laser light source. If the image carrying members are the media on which the latent images are formed without using light, the writing unit effecting an electric or magnetic change on the media may be used.

Figure 2:
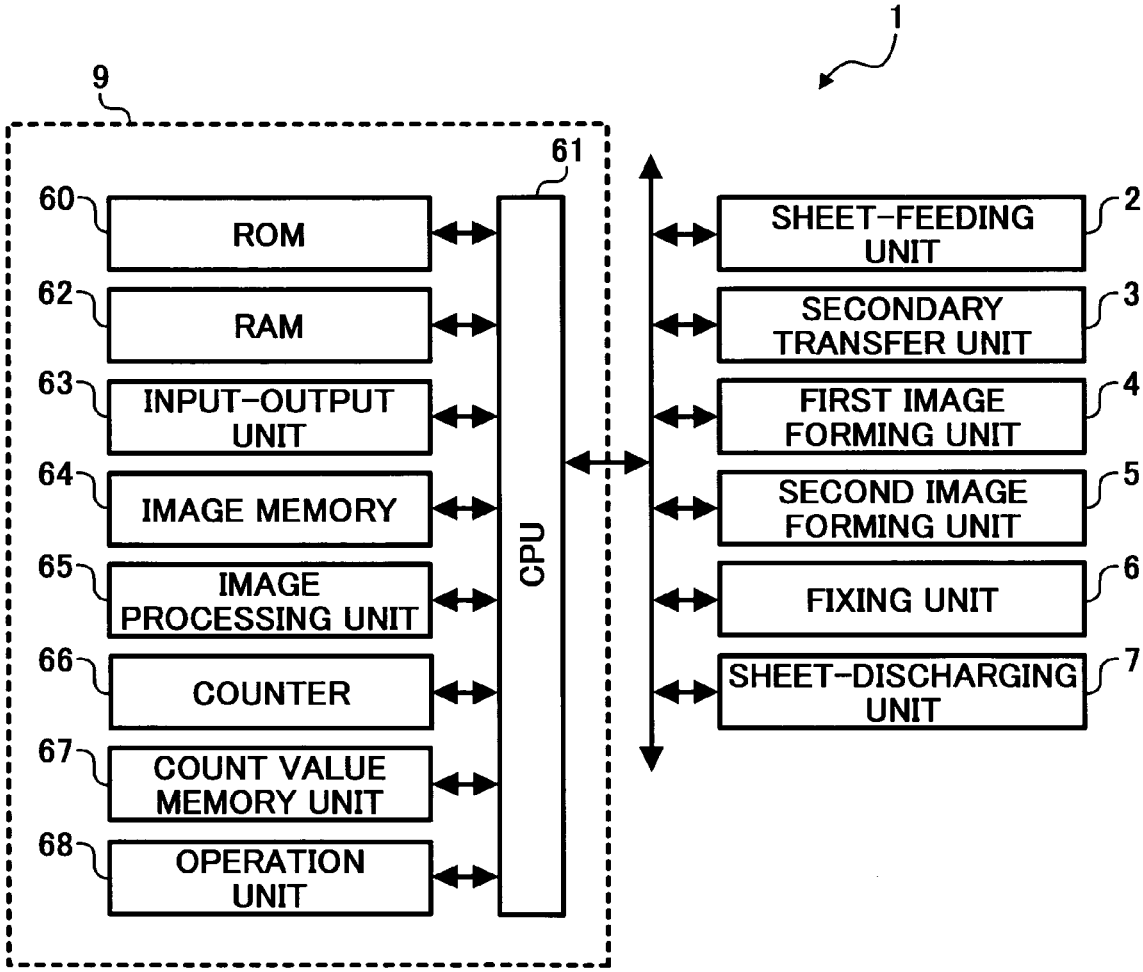
FIG. 2 is a block diagram of a control system of the color image forming apparatus of FIG. 1.

As illustrated in FIG. 2, the control unit 9 includes a ROM (read only memory) 60, a CPU (central processing unit) 61, a RAM (random access memory) 62, an input-output unit 63, an image memory 64, an image processing unit 65, a counter 66, a count value memory unit 67, and an operation unit 68. The CPU 61 is connected to the ROM 60, the RAM 62, the input-output unit 63, the image memory 64, the image processing unit 65, the counter 66, the count value memory unit 67, and the operation unit 68. The CPU 61 is also connected to the sheet-feeding unit 2, the secondary transfer unit 3, the first and second image forming units 4 and 5, the fixing unit 6, and the sheet-discharging unit 7.

The ROM 60 stores programs including operation programs and the like used by the CPU 61 for executing the image forming operations. The CPU 61 appropriately reads out the programs including the operation programs and controls the entirety of the image forming operations. The RAM 62 is appropriately used by the CPU 61 as a memory area. The input-output unit 63 is connected to an external apparatus, and inputs and outputs a variety of signals of image data and so forth. The image memory 64 stores the image data for forming an image. The image processing unit 65 performs a variety of image processing to the image data and creates data writing signals.

The counter 66 performs a counting operation and a count resetting operation according to a command sent by the CPU 61. The counter 66 may perform the counting operation in synchronization with a main-scanning synchronization signal of the writing unit 32, as the CPU 61 uses an interrupt processing. Specifically, upon reception of a mark detection interrupt, the CPU 61 executes the count resetting operation, and executes the counting operation upon every interruption of the main-scanning synchronization signal. Since the counting operation is performed in synchronization with the main-scanning synchronization signal, the write position can be highly accurately controlled by aligning a start position in each scanning movement. Further, a special timer is unnecessary, and thus the structure of the apparatus can be simplified.

Figure 3:
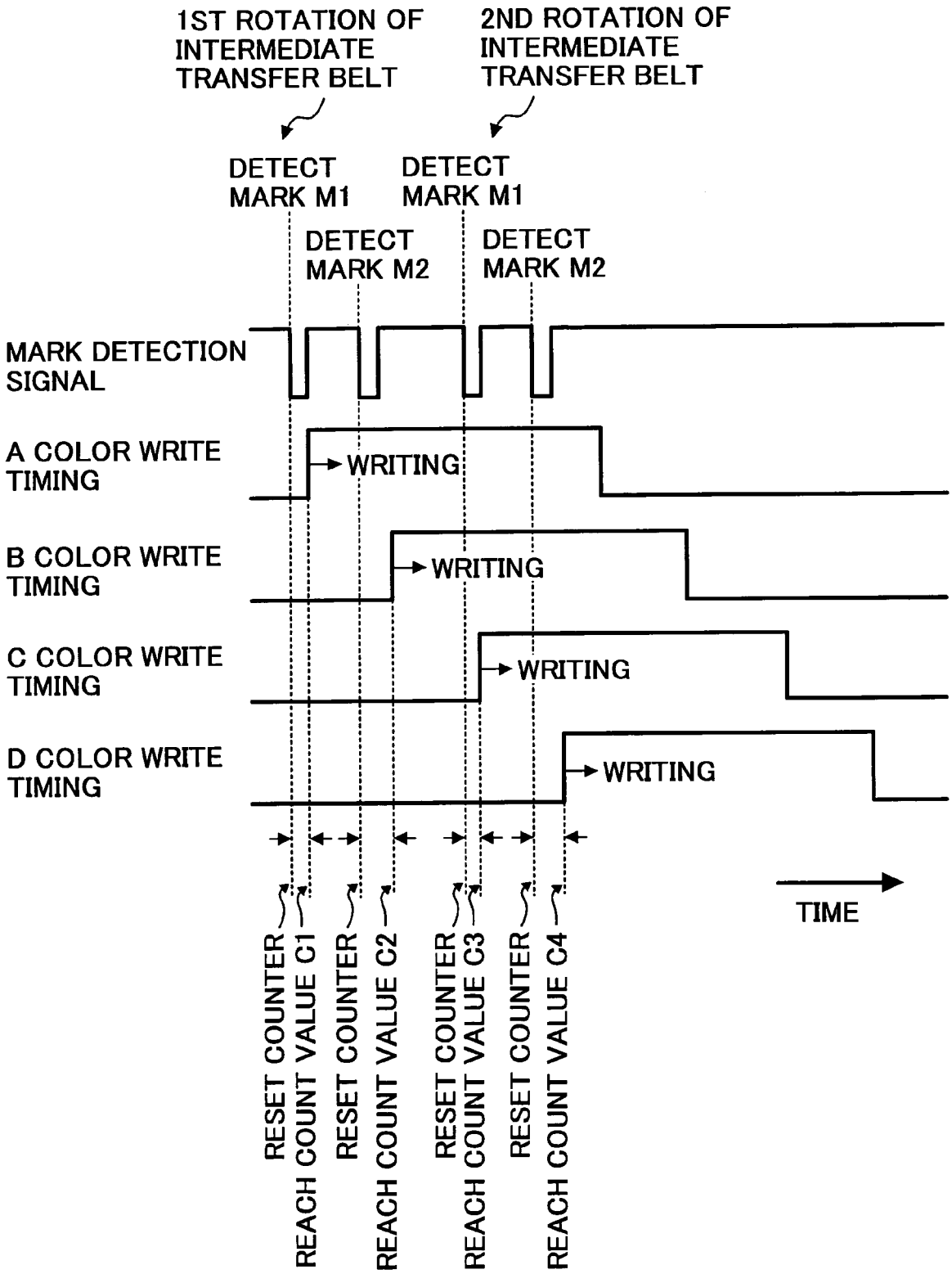
FIG. 3 is a time chart indicating operation timings of the color image forming apparatus of FIG. 1.

The count value memory unit 67 stores count values C1, C2, C3, and C4. As illustrated in a time chart of FIG. 3 which indicates operation timings, the count value C1 corresponds to a value counted by the counter 66 during a time period from the first detection of the mark M1 by the mark detecting unit 23 until the start of optical writing of the A color. The count value C2 corresponds to a value counted by the counter 66 during a time period from the first detection of the mark M2 until the start of optical writing of the B color. The count value C3 corresponds to a value counted by the counter 66 during a time period from the second detection of the mark M1 by the mark detecting unit 23 until the start of optical writing of the C color. The count value C4 corresponds to a value counted by the counter 66 during a time period from the second detection of the mark M2 by the mark detecting unit 23 until the start of optical writing of the D color.

The operation unit 68 receives an input of the count values C1, C2, C3, and C4 through operations performed by a user, and stores the count values C1, C2, C3, and C4 in the count value memory unit 67. It is possible to apply an alternative way of inputting and storing the count values C1, C2, C3, and C4 into the count value memory unit 67.

The count values C1 and C2 are adjusted such that a toner image of the B color is superimposed on a toner image of the A color. The count value C3 is adjusted such that a toner image of the C color is superimposed on a composite toner image of the A color and the B color. The count value C4 is adjusted such that toner images of the A color, the B color, and the C color are superimposed. The count value C1 may be set to zero so that optical writing of the A color starts immediately after detection of the mark M1.

An interval between the marks M1 and M2 is set to a predetermined value in relation to two distances. A first distance is between a distance from a write position of the writing unit 32 on the photoconductor drum 30 to a primary transfer position of the second image forming unit 5 relative to the intermediate transfer belt 20. A second distance is from a write position of the writing unit 42 on the photoconductor drum 40 to a primary transfer position of the second image forming unit 5 relative to the intermediate transfer belt 20. The predetermined value of the interval between the marks M1 and M2 is set as not to exceed a difference between the above-mentioned first and second distances. That is, the distance between the marks M1 and M2 is shorter than a value of the above-mentioned difference between the first and second distances. By being so arranged, superimposing timing of two toner images at the primary transfer position of the second image forming unit 5 may intentionally be shifted. More specifically, it is assumed that writing of latent images by the writing units 32 and 42 start immediately after detections of the marks M1 and M2, respectively. Then, two time periods are considered. A first time period is from a time the writing unit 32 starts writing a first latent image until a time the first latent image is developed into a first visible toner image and is transferred to the primary transfer position of the second image forming unit 5. A second time period is from a time the writing unit 42 starts writing a second latent image until a time the second latent image is developed into a second visible toner image and is transferred to the primary transfer position of the second image forming unit 5. Since the distance between the marks M1 and M2 is, as described above, shorter than the difference between the first and second distances, the second visible toner image reaches the primary transfer position of the second image forming unit 5 earlier than the first visible toner image. In other words, the timing of creating the second visible toner image is needed to be adjusted to synchronize with the timing of the first visible toner image reaching the primary transfer position of the second image forming unit 5. Therefore, it becomes possible to accurately synchronize the superimposing timing of the second visible toner image to the first visible toner image at the primary transfer position of the second image forming unit 5 by adjusting this difference in the distances by using the count values.

Figure 4:
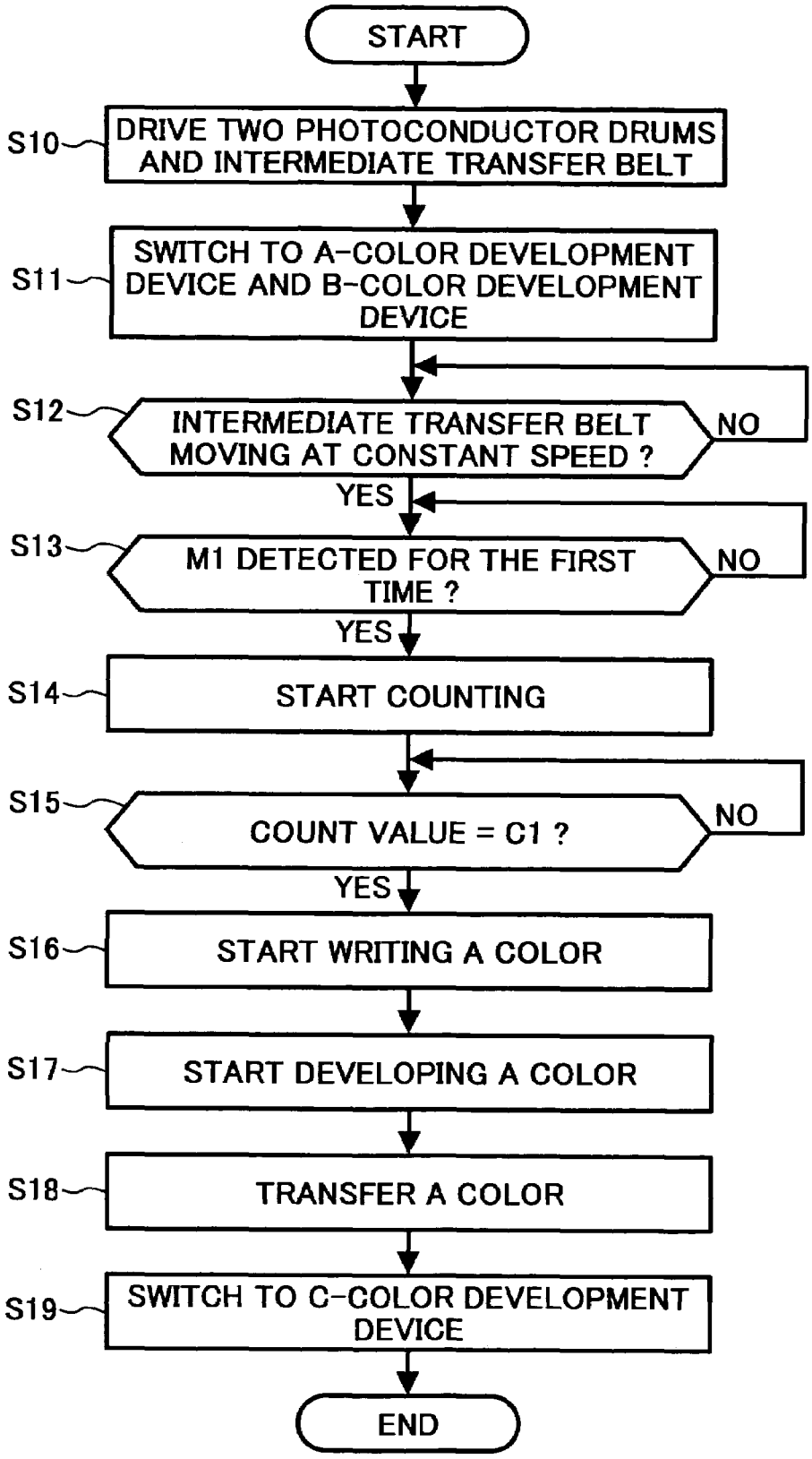
FIG. 4 is a flowchart of a primary transfer operation for transferring a toner image of an A-color.

Referring to FIG. 4, an A-color image forming operation of the color image forming apparatus 1 is explained. As illustrated in FIG. 4, the CPU 61 drives the photoconductor drums 30 and 40 and the intermediate transfer belt 20 upon a receipt of a command to start printing (Step S10). Then, the CPU 61 switches the development unit 33 to the A-color development device 36, and switches the development unit 43 to the B-color development device 46 (Step S1). The CPU 61 uses the speed detecting unit 24 to detect an event that the speed of the intermediate transfer belt 20 reaches a constant value (Step S12). Thereafter, when the CPU 61 receives an input of a mark detection signal representing the first detection of the mark M1 from the mark detecting unit 23 (Step S13), it resets the counter 66 to start the counting operation (Step S14). When the count value of the counter 66 reaches the count value C1 stored in the count value memory unit 67 (Step S15), the CPU 61 causes the writing unit 32 to start an optical writing of the A color on the photoconductor drum 30, so that a formation of an electrostatic latent image of the A color is started (Step S16). Then, the CPU 61 causes the A-color development device 36 to start forming a toner image of the A color (Step S17). The toner image of the A color formed on the photoconductor drum 30 is transferred to the intermediate transfer belt 20 at a contact point between the photoconductor drum 30 and the intermediate transfer belt 20 (Step S18). Upon a completion of the development operation by the A-color development device 36, the CPU 61 switches the development unit 33 to the C-color development device 37 (Step S19). Then, the A-color image forming operation ends.

Figure 5:
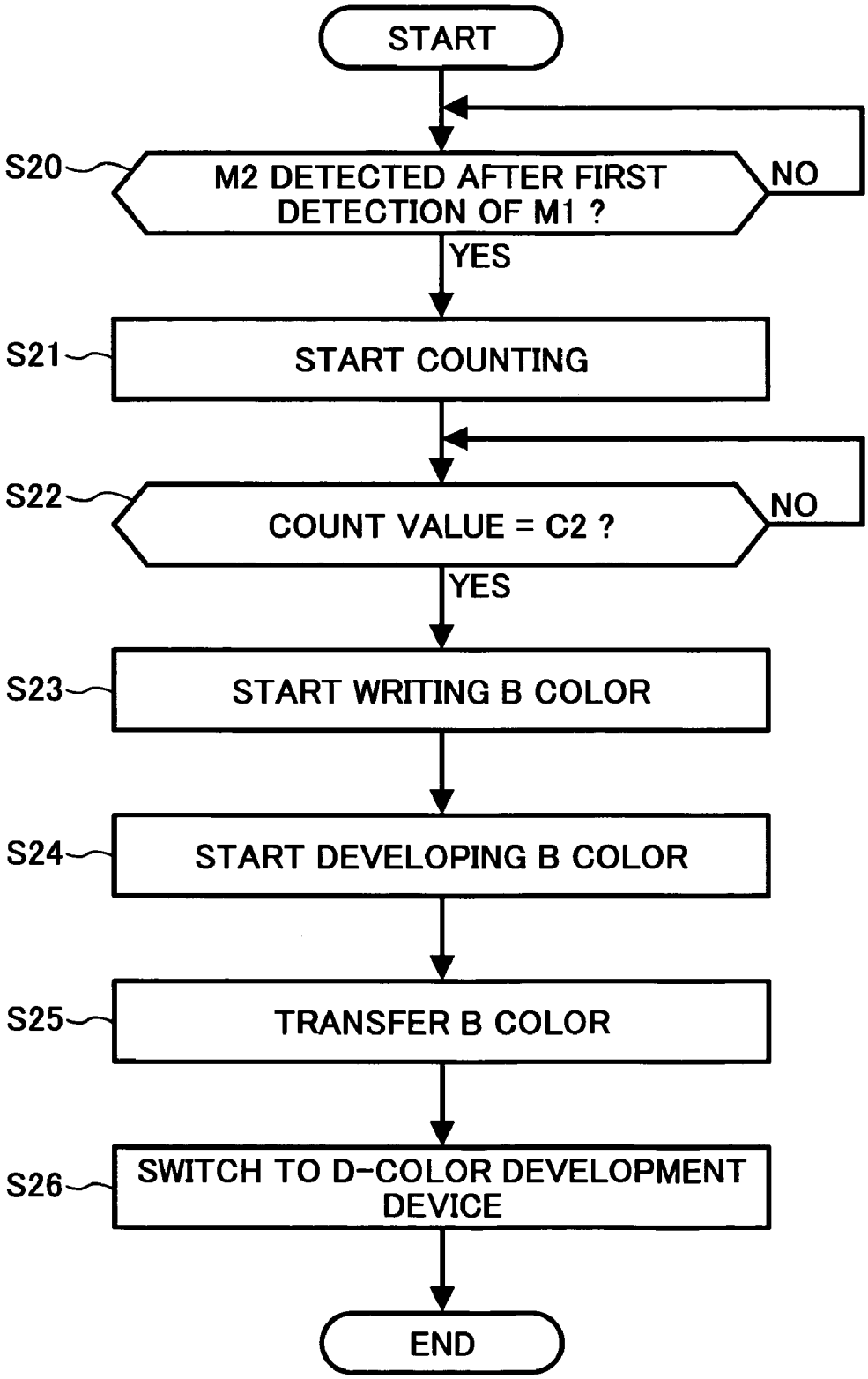
FIG. 5 is a flowchart of a primary transfer operation for transferring a toner image of a B-color.

Referring to FIG. 5, a B-color image forming operation of the color image forming apparatus 1 is explained. As illustrated in FIG. 5, the CPU 61 determines a receipt of an input of a mark detection signal representing a first detection of the mark M2 after having received an input of the mark detection signal representing a first detection of the mark M1 (Step S20). Upon a determination of detecting the mark M2 after the first detection of the mark M1, the CPU 61 resets the counter 66 to start the counting operation (Step S21). The mark M2 is detected during a formation of the toner image of the A color. When the count value of the counter 66 reaches the count value C2 stored in the count value memory unit 67 (Step S22), the CPU 61 causes the writing unit 42 to start optical writing of the B color on the photoconductor drum 40, so that a formation of an electrostatic latent image of the B color is started (Step S23). Then, the CPU 61 causes the B-color development device 46 to start forming a toner image of the B color (Step S24). The toner image of the B color is formed on the photoconductor drum 40 in accordance with the count value C2. Thus, the toner image of the B color is transferred to the intermediate transfer belt 20 so as to be superimposed on the toner image of the A color. Accordingly, a composite toner image of the A color and the B color is formed on the intermediate transfer belt 20 (Step S25). Upon a completion of the development operation by the B-color development device 46, the CPU 61 switches the development unit 43 to the D-color development device 47 (Step S26). Then, the B-color image forming operation ends.

Figure 6:
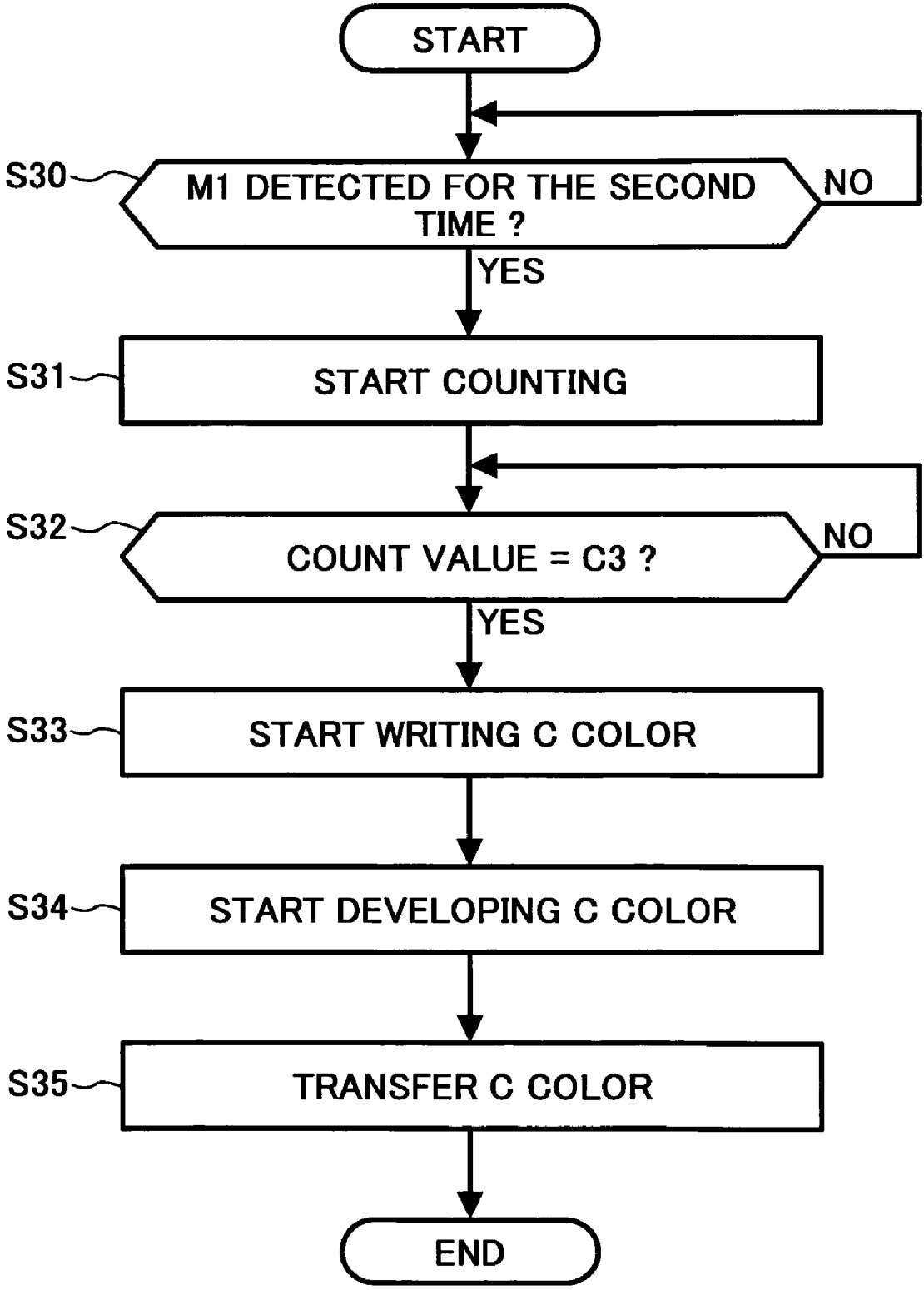
FIG. 6 is a flowchart of a primary transfer operation for transferring a toner image of a C-color.

Referring to FIG. 6, a C-color image forming operation of the color image forming apparatus 1 is explained. As illustrated in FIG. 6, the CPU 61 determines a receipt of an input of a mark detection signal representing the second detection of the mark M1 from the mark detecting unit 23 after the intermediate transfer belt 20 has been rotated one round (Step S30). Upon a determination of such second detection of the mark M1, the CPU 61 resets the counter 66 to start the counting operation (Step S31). When the count value of the counter 66 reaches the count value C3 stored in the count value memory unit 67 (Step S32), the CPU 61 causes the writing unit 32 to start optical writing of the C color on the photoconductor drum 30, so that formation of an electrostatic latent image of the C color starts (Step S33). Then, the CPU 61 causes the C-color development device 37 to start forming a toner image of the C color (Step S34). The toner image of the C color is formed on the photoconductor drum 30 in accordance with the count value C3. Thus, the toner image of the C color is transferred to the intermediate transfer belt 20 so as to be superimposed on the toner images of the A color and the B color. Accordingly, a composite toner image of the A color, the B color, and the C color is formed on the intermediate transfer belt 20 (Step S35). Then, the C-color image forming operation ends.

Figure 7:
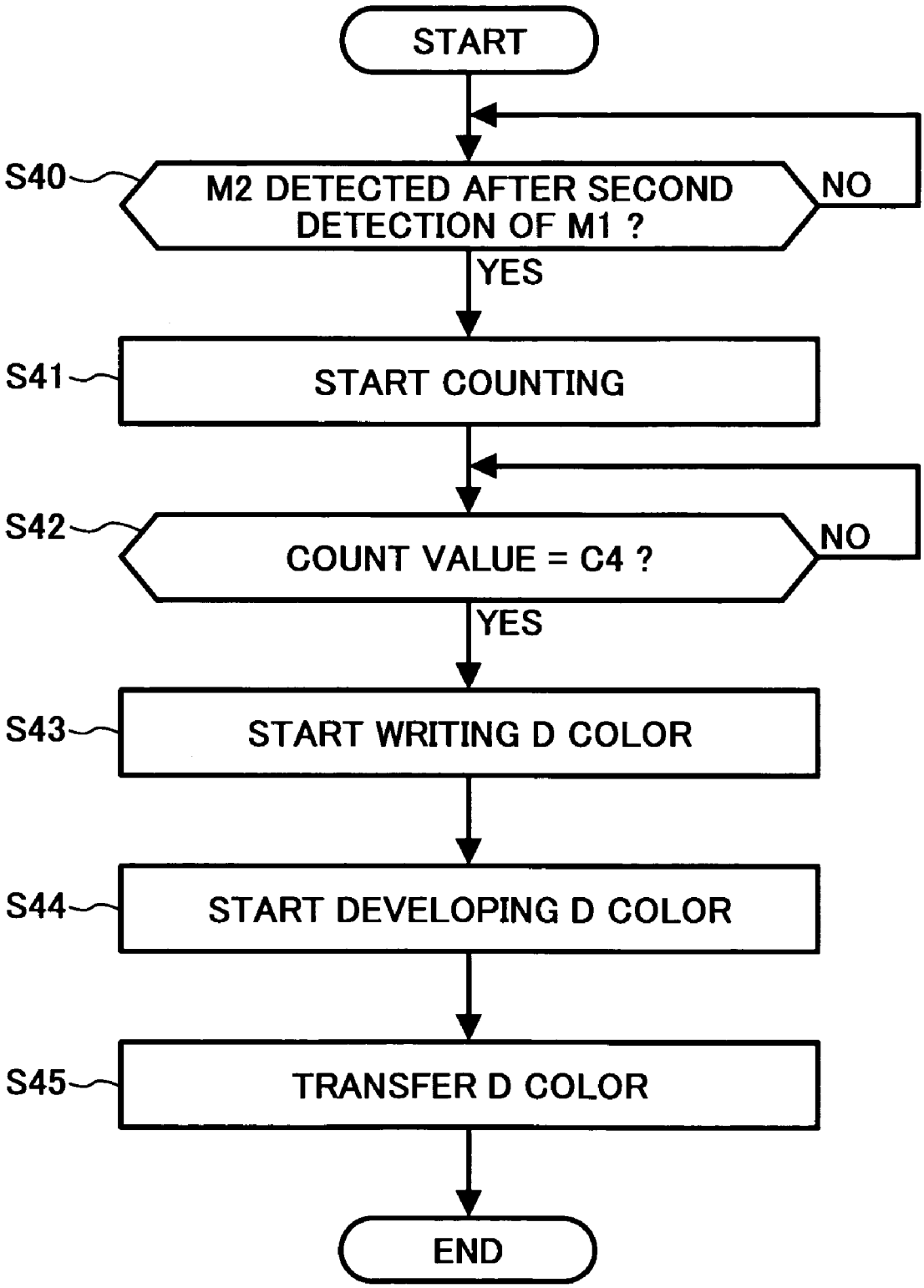
FIG. 7 is a flowchart of a primary transfer operation for transferring a toner image of a D-color.

Referring to FIG. 7, a D-color image forming operation of the color image forming apparatus 1 is explained. As illustrated in FIG. 7, the CPU 61 determines a receipt of an input of a mark detection signal representing a detection of the mark M2 after having received the second input of the mark detection signal representing the detection of the mark M1 (Step S40). Upon a determination of such detection of the mark M2, the CPU 61 resets the counter 66 to start the counting operation (Step S41). The mark M2 is detected during formation of the toner image of the C color. When the count value of the counter 66 reaches the count value C4 stored in the count value memory unit 67 (Step S42), the CPU 61 causes the writing unit 42 to start optical writing of the D color on the photoconductor drum 40, so that formation of an electrostatic latent image of the D color starts (Step S43). Then, the CPU 61 causes the D-color development device 47 to start forming a toner image of the D color (Step S44). The toner image of the D color is formed on the photoconductor drum 40 in accordance with the count value C4. Thus, the toner image of the D color is transferred to the intermediate transfer belt 20 so as to be superimposed on the toner images of the A color, the B color, and the C color. Accordingly, a full-color toner image of the A color, the B color, the C color, and the D color is formed on the intermediate transfer belt 20 (Step S45). Then, the D-color image forming operation ends.

The full-color toner image formed by superimposing the toner images on the intermediate transfer belt 20 is transferred at one time onto the transfer sheet conveyed by the secondary transfer roller 25 from the sheet-feeding unit 2. The full-color toner image transferred to the transfer sheet is fixed thereon by the fixing unit 6, and then the transfer sheet is discharged by the sheet-discharging unit 7.

Thus, in the image forming apparatus 1, optical writing of each color starts at predetermined counts after detection of the mark M1 or M2. Therefore, the marks M1 and M2 are not necessarily needed to be placed with their interval highly accurately equalized with the distance between the primary transfer position of the photoconductor drum 30 and the primary transfer position of the photoconductor drum 40. Accordingly, the toner images can be accurately superimposed while simplifying the structure of the intermediate transfer belt 20.

Figure 8:
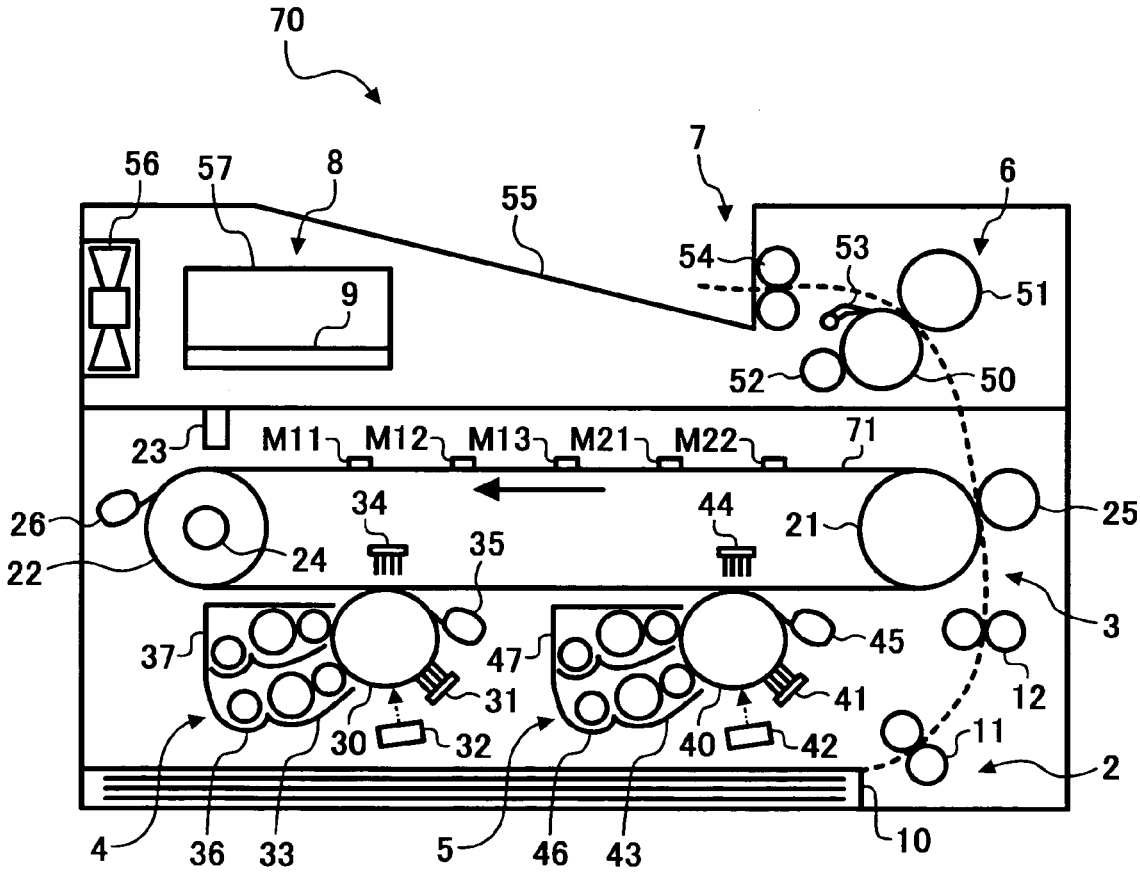
FIG. 8 is a schematic illustration of a color image forming apparatus according to another embodiment of the present invention.

Referring to FIG. 8, a color image forming apparatus 70 according to another embodiment of the present invention is explained. The color image forming apparatus 70 of FIG. 8 is similar to the color image forming apparatus 1 of FIG. 1, except for an intermediate transfer belt 71. As illustrated in FIG. 8, the intermediate transfer belt 71 is provided on an upper surface thereon with five marks M11, M12, M13, M21, and M22, for example. These marks M11, M12, M13, M21, and M22 are formed such that four of these marks M11, M12, M13, M21, and M22 are located within a distance equivalent to a distance between the two primary transfer positions for the photoconductor drums 30 and 40 relative to the intermediate transfer belt 20. Also, the marks M11, M12, M13, M21, and M22 are placed at regular intervals in a non-image region on the intermediate transfer belt 71.

The mark M11 is used as a reference in the optical writing of the A color and the C color, while the mark M21 is used as a reference in the optical writing of the B color and the D color. A distance between the marks M11 and M21 is substantially equal to or shorter than the distance between the primary transfer positions between the photoconductor drums 30 and 40. More specifically, this distance between the marks M21 and M11 is the closest distance to the distance between the primary transfer positions of the photoconductor drums 30 and 40 among the distances between the marks M11, M12, M13, M21, and M22.

Figure 9:
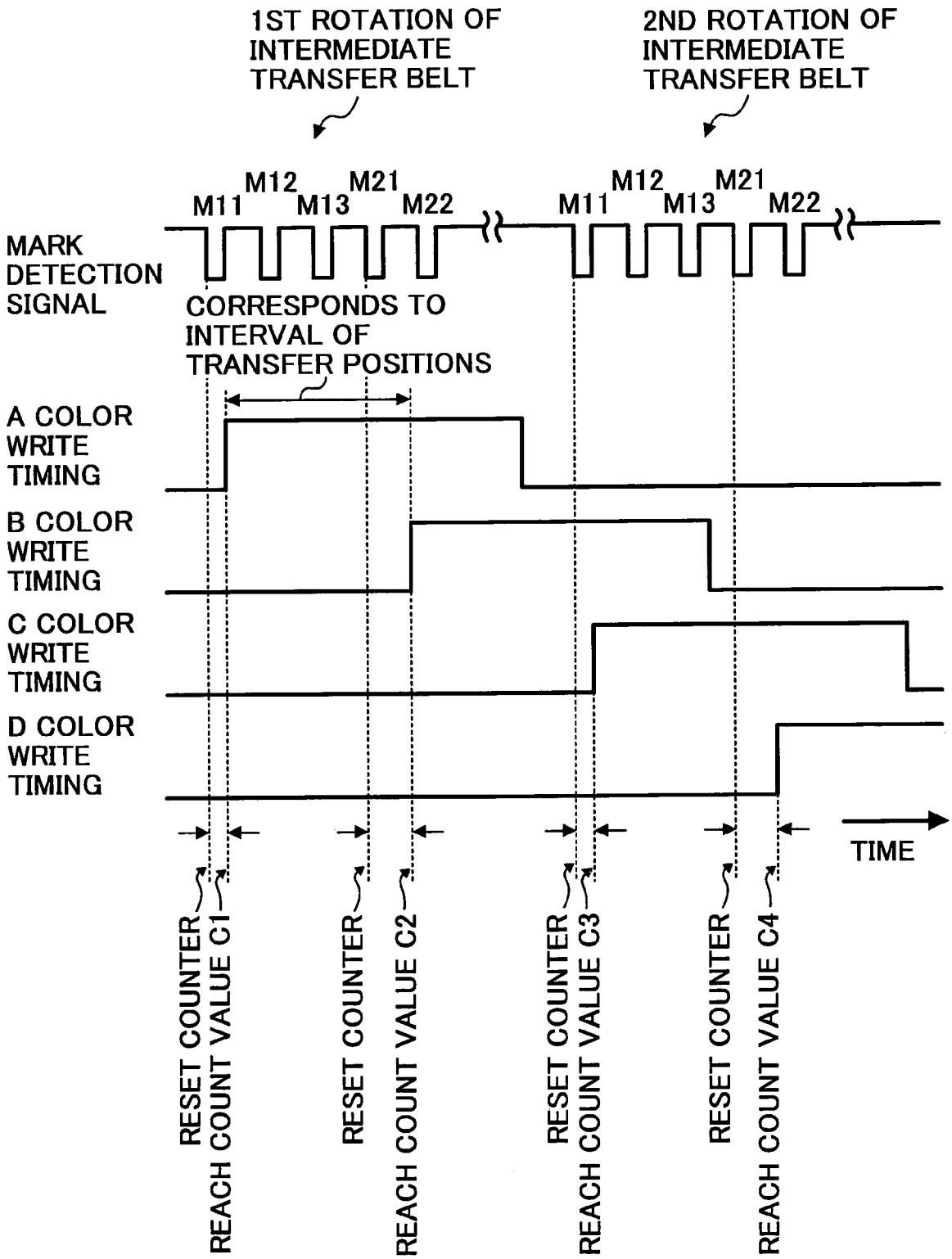
FIG. 9 is a time chart indicating operation timings of the color image forming apparatus of FIG. 8.

The count value memory unit 67 stores the count values C1, C2, C3, and C4. As illustrated in FIG. 9, the count value C1 corresponds to a value counted by the counter 66 during a time period from the first detection of the mark M11 by the mark detecting unit 23 until the start of optical writing of the A color. The count value C2 corresponds to a value counted by the counter 66 during a time period from the first detection of the mark M21 until the start of optical writing of the B color. The count value C3 corresponds to a value counted by the counter 66 during a time period from the second detection of the mark M11 by the mark detecting unit 23 until the start of optical writing of the C color. The count value C4 corresponds to a value counted by the counter 66 during a time period from the second detection of the mark M21 by the mark detecting unit 23 until the start of optical writing of the B color.

After the mark detecting unit 23 detects the mark M11, the CPU 61 counts the number of marks detected by the mark detecting unit 23 and selects the mark M21. Control by the CPU 61 at the time of interruption may be performed to select the mark M21 such that marks detected by the mark detecting unit 23 are ignored during a time from detection of the mark 11 by the mark detecting unit 23 until immediately before detection of the mark 21.

The image forming operation performed by the color image forming apparatus 70 of FIG. 8 is similar to the image forming operation performed by the color image forming apparatus 1 of FIG. 1, except that the mark M11 replaces the mark M1 as the reference in the optical writing of the A color and the C color, and the mark M21 replaces the mark M2 as the reference in the optical writing of the B color and the D color.

As described above, the color image forming apparatus 70 is configured to start an optical writing of each color at a predetermined number of counts after a detection of the mark M11 or M21. Therefore, the marks M11 and M21 are not necessarily needed to be placed with their interval highly accurately equalized with the distance between the primary transfer positions of the photoconductor drum 30 and the photoconductor drum 40. Therefore, the toner images can be accurately superimposed while simplifying the structure of the intermediate transfer belt 20.

Further, the color image forming apparatus 70 is configured to select the mark M21 and uses it as a reference in the optical writing of the B color and the D color. The mark M21 is placed with a distance from the mark M11. This distance between the mark M21 to the mark M11 is substantially equal to or shorter than the distance between the primary transfer positions of the photoconductor drums 30 and 40. Furthermore, this distance of the mark M21 to the mark M11 is the closest distance to the distance between the primary transfer positions of the photoconductor drums 30 and 40 among the distances between the marks M11, M12, M13, M21, and M22. Accordingly, the color image forming apparatus 70 is capable of preventing misalignment of the superimposed toner images caused by a change in the speed of the intermediate transfer belt 20 and the like.

Figure 10:
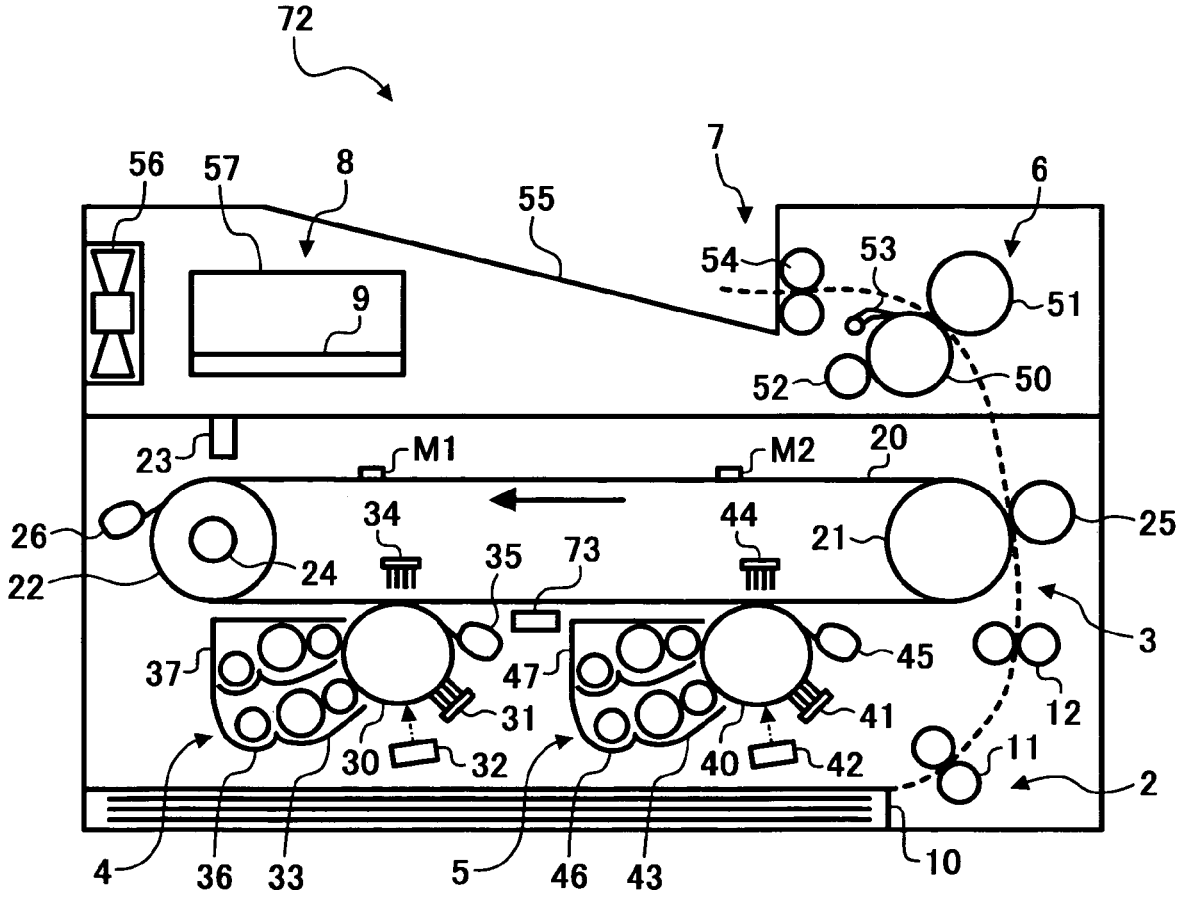
FIG. 10 is a schematic illustration of a color image forming apparatus according to another embodiment of the present invention.
Figure 11:
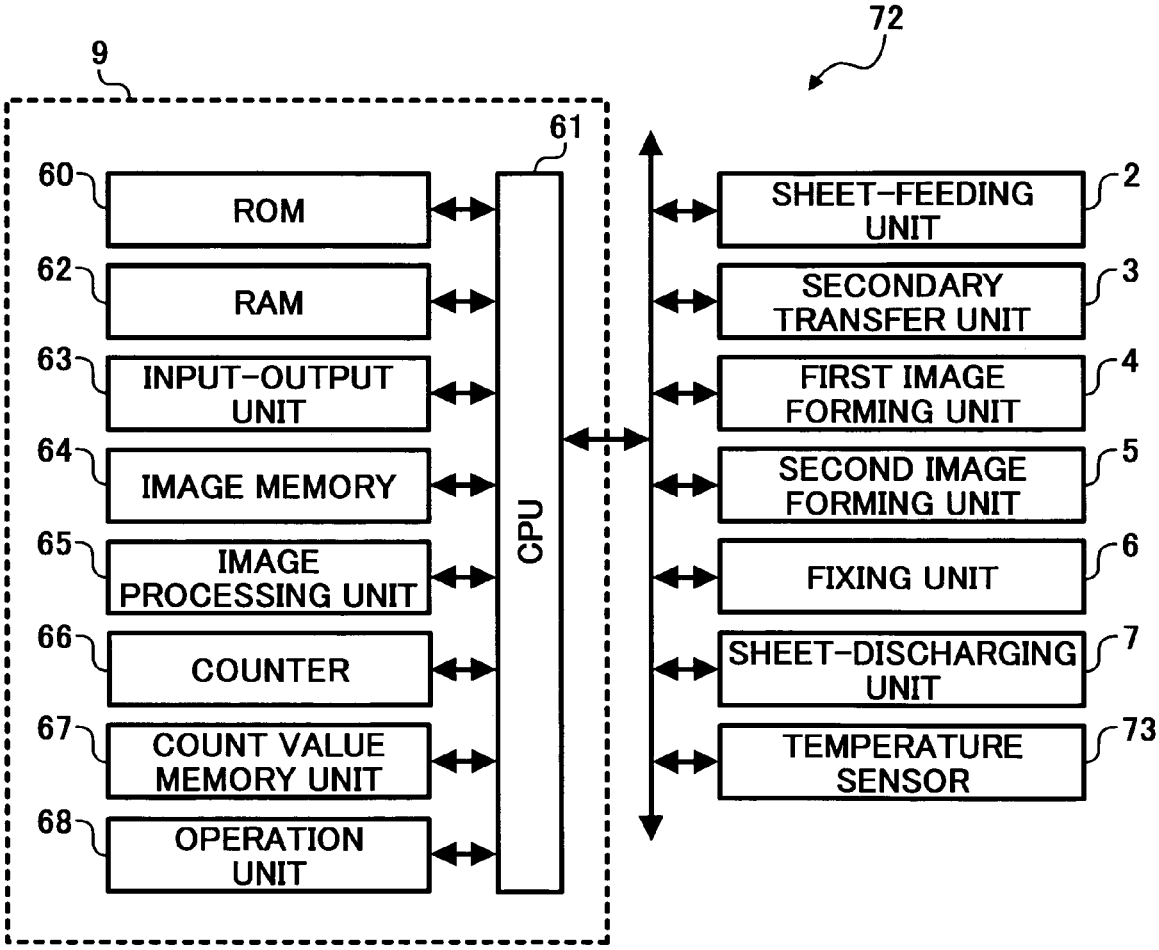
FIG. 11 is a block diagram of a control system of the color image forming apparatus of FIG. 10.

Referring to FIGS. 10 and 11, a color image forming apparatus 72 according to another embodiment of the present invention is explained. The color image forming apparatus 72 of FIGS. 10 and 11 is similar to the color image forming apparatus 1 of FIG. 1, except for a temperature sensor 73.

The temperature sensor 73 is placed near the intermediate transfer belt 20 for detecting the temperature of the intermediate transfer belt 20. The temperature sensor 73 is preferably used to measure temperatures at the primary transfer positions at which the intermediate transfer belt 20 faces the photoconductor drum 30 and the photoconductor drum 40. The temperature sensor 73 also measures a temperature at a position somewhere between the primary transfer positions of the photoconductor drum 30 and the photoconductor drum 40.

The count value memory unit 67 stores a count value $C_n$ (n=1, 2, 3, and 4) in accordance with the temperature detected by the temperature sensor 73. If the temperature of the interior of the color image forming apparatus 72 is increased due to continuous use of the color image forming apparatus 72, the length of the intermediate transfer belt 20 changes. Therefore, a relationship between a change in the temperature detected by the temperature sensor 73 and a change in the length of the intermediate transfer belt 20 is previously measured, and the count value $C_n$ (n=1, 2, 3, and 4) in accordance with the temperature detected by the temperature sensor 73 is stored.

The image forming operation performed by the color image forming apparatus 72 of FIGS. 10 and 11 is similar to the color image forming operation performed by the color image forming apparatus 1 of FIG. 1, except that, when the CPU 61 reads out the count value $C_n$ (n=1, 2, 3, and 4) from the count value memory unit 67, the CPU 61 selects the count value in accordance with the temperature detected by the temperature sensor 73.

In this way, the color image forming apparatus 72 is configured to select the appropriate count value $C_n$ in accordance with the change in the length of the intermediate transfer belt 20 caused by the change in the temperature of the intermediate transfer belt 20. Accordingly, a high-quality image having no color drift can be formed by finely adjusting the leading end position of an image in consideration of expansion and contraction of the intermediate transfer belt 20.

Figure 12:
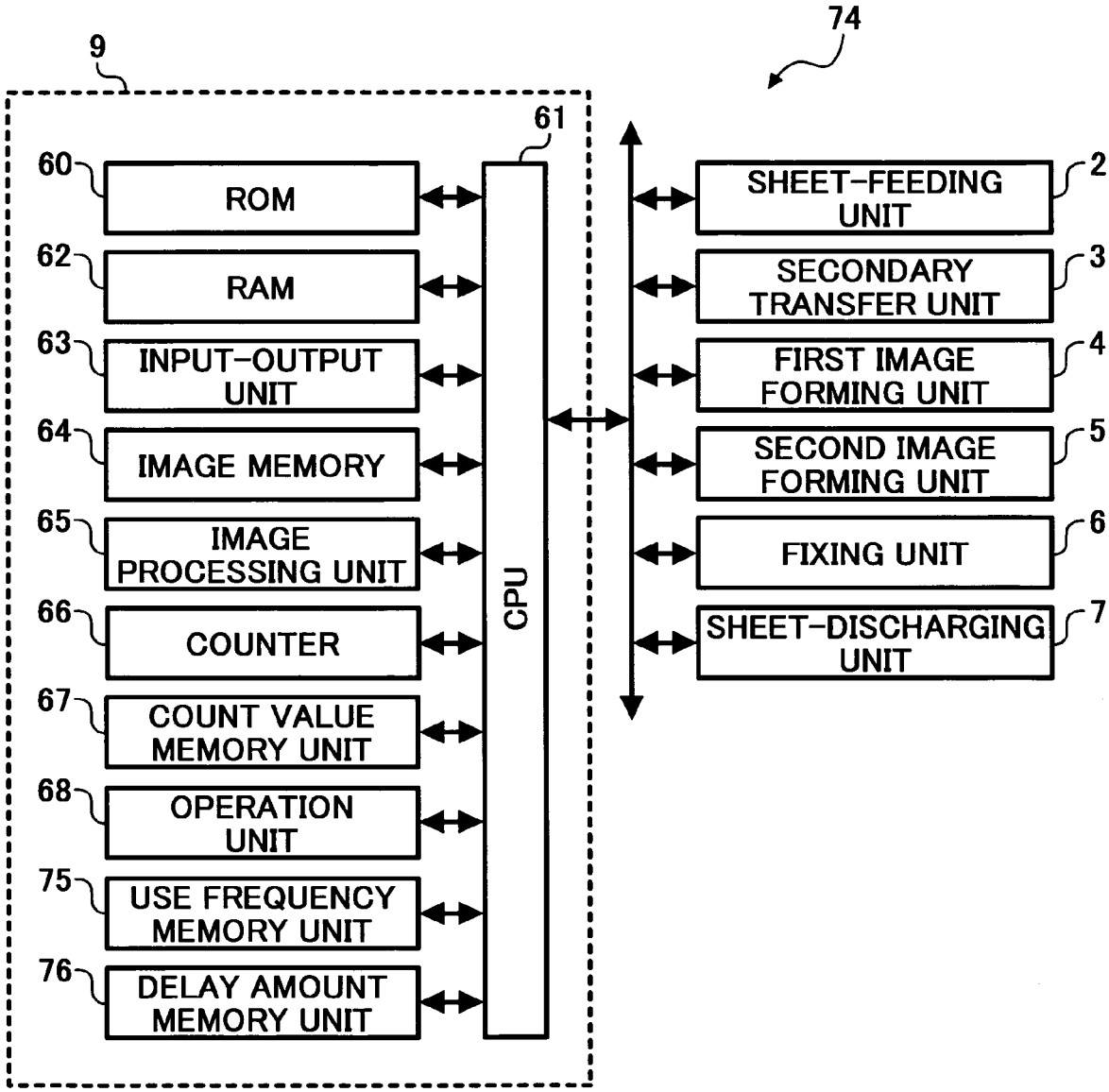
FIG. 12 is a block diagram of a control system of a color image forming apparatus according to another embodiment of the present invention.

Referring to FIG. 12, a color image forming apparatus 74 according to another embodiment of the present invention is explained. The color image forming apparatus 74 of FIG. 12 is similar to the color image forming apparatus 1 of FIG. 1, except for a use frequency memory unit 75 and a delay amount memory unit 76.

The use frequency memory unit 75 stores the number of printed sheets. The delay amount memory unit 76 stores data representing a relationship between the number of printed sheets and the delay amount. The delay amount is an amount of displacement of a position at which a full-color toner image is formed on the intermediate transfer belt 20. The position is displaced each time the number of printed sheets exceeds a predetermined value, and the amount of displacement is expressed in the count value counted by the counter 66.

The image forming operation performed by the color image forming apparatus 74 is similar to the image forming operation of the color image forming apparatus 1, except for the following two operations. That is, a first operation is that the number of printed sheets stored in the use frequency memory unit 75 is counted up in each image forming operation executed by the CPU 61. A second operation is that the CPU 61 reads the delay amount from the delay amount memory unit 76 in accordance with the number of printed sheets stored in the use frequency memory unit 75 and subsequently adds the read delay amount to each of the count values $C_n$ (n=1, 2, 3, and 4) read out from the count value memory unit 67.

The CPU 61 counts the number of printed sheets, and changes the timing of writing each color by the same count value at each time the count value exceeds a predetermined count value. By so controlling, the CPU 61 delays the timing of starting the writing operation and arbitrarily changes the position of an image formed on the intermediate transfer belt 20.

In this way, the color image forming apparatus 74 is configured to change the position of the full-color toner image formed on the intermediate transfer belt 20 as the number of printed sheets increases. The intermediate transfer belt 20 can thereby have a relatively longer lifetime with a suppression of deterioration over time.

Alternatively, another unit of use frequency may be used. For example, the use frequency memory unit 75 may store a use time, and the delay amount memory unit 76 may store the delay amount in accordance with the use time.

Figure 13:
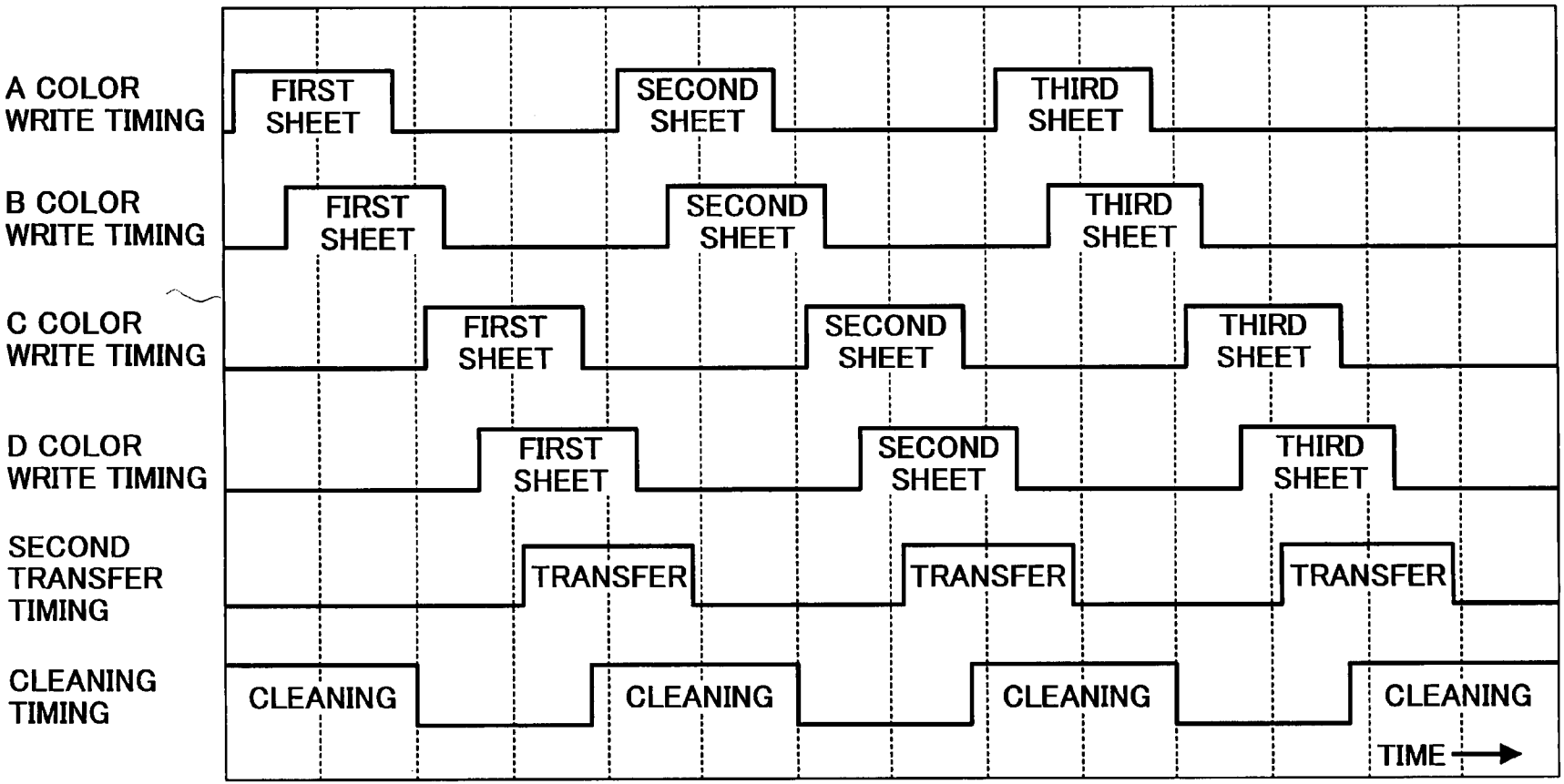
FIG. 13 is a time chart indicating operation timings of a color image forming apparatus according to another embodiment of the present invention.

Referring to FIG. 13, another image forming operation performed by the color image forming apparatus 1 of FIG. 1 is explained. In this image forming operation, the color image forming apparatus 1 stores the count values $C_n$ (n=1, 2, 3, and 4) in the count value memory unit 67 in accordance with a toner image count, that is, which of the image formations is performed in a continuous image forming operation. The image forming operations of the present embodiment are similar to the image forming operations of the color image forming apparatus 1, except that the CPU 61 executes the counting operation to find on which one of the transfer sheets a toner image is formed in the continuous image forming operation and selects the count value to be read out from the count value memory unit 67 in accordance with on which one of the transfer sheets the toner image is formed.

As illustrated in FIG. 13, writing of the A color starts and then writing of the B color starts on the first sheet. Then, writing of the C color starts during the writing of the B color subsequent to the writing of the A color. Thereafter, writing of the D color starts during the writing of the C color subsequent to the writing of the B color. Timings of writing the respective colors of the A color, the B color, the C color, and the D color on the second and following sheets are the same as the timings for the writing on the first sheet. Writing of the A color on a sheet starts during writing of the D color on a previous sheet, and writing of the B color on the sheet starts after writing of the D color on the previous sheet.

During writing of the colors on the first sheet, the second transfer roller 25 does not contact the intermediate transfer belt 20 at the start of writing each color on the first sheet, but contacts the intermediate transfer belt 20 during writing of the C color and the D color. During writing of the colors on the second and following sheets, the secondary transfer roller 25 contacts the intermediate transfer belt 20 at the start of writing the A color and the B color on the sheets, separates from the intermediate transfer belt 20 during writing of the A color and the B color, and contacts the intermediate transfer belt 20 during writing of the C color and the D color.

During writing of the colors on the first sheet, the belt cleaning unit 26 contacts the intermediate transfer belt 20 prior to writing of the A color, separates from the intermediate transfer belt 20 during writing of the B color, i.e., subsequent to writing of the A color and prior to writing of the C color, and contacts the intermediate transfer belt 20 during writing of the D color subsequent to writing of the C color.

A load on the intermediate transfer belt 20 changes, as the secondary transfer roller 25 and the belt cleaning unit 26 come in contact with or separate from the intermediate transfer member 20. Therefore, the moving speed of the intermediate transfer belt 20 changes. The count value stored in the snout value memory unit 67 is determined based on an expected change in the speed of the intermediate transfer belt 20 in consideration of differences in the load on the intermediate transfer belt 20 according to on which one of transfer sheets a toner image being formed is located.

In this way, the color image forming apparatus 1 is configured to perform the image forming operation of FIG. 13 in which the count value read out from the count value memory unit 67 is selected in accordance with the toner image on which one of the transfer sheets is formed. Accordingly, the color drift can be prevented from occurring in the toner images superimposed on the intermediate transfer belt 20.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JP2005-048183 filed on Feb. 24, 2005 in the Japan Patent Office, the entire contents of which are incorporated by reference herein.

What is claimed as new and desired to be secured by Letters Patent of the United States is:

1. An image forming apparatus, comprising:

a plurality of image forming units including nth and (n+1) th image forming units numbered in an order of a predetermined image forming sequence, in which n is a positive integer, said image forming units are configured to write latent images on rotating image carrying members at write positions and to develop the latent images;

an intermediate transfer member configured to rotate to pass respective transfer positions at which the developed images are transferred to the intermediate transfer member from the respective image carrying members of the plurality of image forming units;

a plurality of marks including nth and (n+1)th marks placed along a rotation direction of the intermediate transfer member, wherein an interval between the nth and (n+1)th marks is substantially equal to or smaller than a distance between a write position of the nth image forming unit to a primary transfer position of the (n+1)th image forming unit and a distance between a write position of the (n+1)th image forming unit to the primary transfer position of the (n+1)th image forming unit;

a mark detecting mechanism configured to detect the marks at a fixed position;

a counter configured to reset and restart counting time upon a detection of each of the marks by the mark detecting mechanism;

a count value memory unit configured to store a count value $C_n$ counted during a time period from a detection of the nth mark until a start of writing on the image carrying member in the nth image forming unit, and a count value $C_{(n+1)}$ counted during a time period from detection of the (n+1)th mark until a start of writing on the image carrying member in the (n+1)th image forming unit;

a use frequency memory unit configured to store a number of printed sheets;

a delay amount memory unit configured to store data representing a relationship between the number of printed sheets and an amount of displacement of a position at which a full-color toner image is formed on the intermediate transfer member; and a controller configured to reset the counter to start counting time upon detection of the nth and (n+1)th marks, respectively, by the mark detecting mechanism and to instruct the nth image forming unit and the (n+1)th image forming unit to start writing on the image carrying member when the counter reaches the count value Cn, and $C_{(n+1)}$, the controller being configured to change the transfer positions on the intermediate transfer member based on the delay amount output from the delay amount memory unit, as a use frequency of the intermediate transfer member increases.

2. The image forming apparatus as described in claim 1, wherein the nth and the (n+1)th marks are separated by a plurality of marks and an interval between the nth and the (n+1)th marks is substantially equal to or smaller than the distance between the write position of the nth image forming unit to the primary transfer position of the (n+1)th image forming unit and the distance between the write position of the (n+1)th image forming unit to the primary transfer position of the (n+1)th image forming unit.

3. The image forming apparatus as described in claim 1, further comprising:

a temperature detecting mechanism configured to detect a temperature of a vicinity of the intermediate transfer member, wherein the count value is set in accordance with the temperature detected by the temperature detecting mechanism.

4. The image forming apparatus as described in claim 3, wherein the count value to be set is increased as the temperature increases.

5. The image forming apparatus as described in claim 1, wherein the counter is in synchronization with a main-scanning synchronization signal.

6. The image forming apparatus as described in claim 1, wherein at least one of the plurality of image forming units includes a plurality of development mechanisms for developing the latent images and is configured to switch between the plurality of development mechanisms at one or more rotation of the intermediate transfer member.

7. The image forming apparatus as described in claim 6, wherein the count value is different at each of the development mechanisms.

8. The image forming apparatus as described in claim 1, wherein the count value is set to be a large value when a large load is applied to the intermediate transfer member and the count value is set to be a small value when a small load is applied to the intermediate transfer member.

9. An image formation means, comprising:

plurality of image forming means for writing latent images on rotating image carrying members at write positions and developing the latent images, wherein said plurality of image forming means includes nth and (n+1)th image forming means numbered in an order of a predetermined image forming sequence, in which n is a positive integer;

intermediate transfer means for rotating to pass respective transfer positions at which the developed images are transferred to the intermediate transfer means from the respective image carrying members of the plurality of image forming means;

plurality of marks including nth and (n+1)th marks placed along a rotation direction of the intermediate transfer means, wherein an interval between the nth and (n+1)th marks is substantially equal or smaller than a distance between a write position of the nth image forming unit to a primary transfer position of the (n+1)th image forming unit and a distance between a write position of the (n+1) th image forming unit to the primary transfer position of the (n+1)th image forming unit;

mark detecting means for detecting the marks at a fixed position;

counter means for counting time by resetting and restarting counting upon a detection of each of the marks by the mark detecting means;

count value memory means for storing a count value $C_n$ counted during a time period from a detection of the nth mark until a start of writing on the image carrying member in the nth image forming means, and a count value $C_{(n+1)}$ counted during a time period from detection of the (n+1)th mark until a start of writing on the image carrying member in the (n+1)th image forming means;

use frequency memory means for storing a number of printed sheets;

delay amount memory means for storing data representing a relationship between the number of printed sheets and an amount of displacement of a position at which a full-color toner image is formed on the intermediate transfer means; and controller means for resetting the counter means to start counting time upon detection of the nth and (n+1)th marks, respectively, by the mark detecting means and to instruct the nth image forming means and the (n+1)th image forming means to start writing on the image carrying means when the counter means reaches the count value $C_n$, and $C_{(n+1)}$, the controller means changes the transfer positions on the intermediate transfer means based on the delay amount output from the delay amount memory means, as a use frequency of the intermediate transfer means increases.

10. The image formation means as described in claim 9, wherein the nth and the (n+1)th marks are separated by a plurality of marks and an interval between the nth and the (n+1)th marks is substantially equal to or smaller than the distance between the write position of the nth image forming unit to the primary transfer position of the (n+1)th image forming unit and the distance between the write position of the (n+1)th image forming unit to the primary transfer position of the (n+1)th image forming unit.

11. The image formation means as described in claim 9, further comprising:

temperature detecting means for detecting a temperature of a vicinity of the intermediate transfer means, wherein the count value is set in accordance with the temperature detected by the temperature detecting means.

12. The image formation means as described in claim 11, wherein the count value to be set increases as the temperature increases.

13. The image formation means as described in claim 9, wherein the counter means is synchronized with a main-scanning synchronization signal.

14. The image formation means as described in claim 9, wherein at least one of the plurality of image forming means includes a plurality of development means for developing the latent images and switching between the plurality of development means at one or more rotation of the intermediate transfer means.

15. The image formation means as described in claim 14, wherein the count value is different at each of the development means.

16. The image formation means as described in claim 9, wherein the count value is set to be a large value when a large load is applied to the intermediate transfer means and the count value is set to be a small value when a small load is applied to the intermediate transfer means.

* * * * *